US006688699B1

(12) United States Patent
Bowie

(10) Patent No.: US 6,688,699 B1
(45) Date of Patent: Feb. 10, 2004

(54) MODULAR FURNITURE

(75) Inventor: Ronald Bowie, Harlan, IN (US)

(73) Assignee: Transformations, Grabill, IN (US)

( * ) Notice: Subject to any disclaimer, the term of this patent is extended or adjusted under 35 U.S.C. 154(b) by 0 days.

(21) Appl. No.: 10/356,413

(22) Filed: Jan. 31, 2003

(51) Int. Cl.[7] ..... A47C 7/00
(52) U.S. Cl. ..... 297/440.14; 297/440.13
(58) Field of Search ..... 297/440.13, 440.15, 297/440.16, 440.1

(56) References Cited

U.S. PATENT DOCUMENTS

| | | | | |
|---|---|---|---|---|
| 2,279,864 | A | * | 4/1942 | Eide |
| 2,615,505 | A | * | 10/1952 | Friedlander |
| 4,140,065 | A | | 2/1979 | Chacon |
| 4,188,067 | A | * | 2/1980 | Elmer |
| 4,464,075 | A | | 8/1984 | Kellogg |
| 4,509,794 | A | | 4/1985 | Roland |
| 4,700,916 | A | | 10/1987 | Bastian et al. |
| 4,765,253 | A | | 8/1988 | Schappach |
| 5,000,512 | A | | 3/1991 | Laird |
| 5,011,228 | A | | 4/1991 | Marcantel |
| 5,338,095 | A | | 8/1994 | Laughlin et al. |
| 5,423,597 | A | | 6/1995 | Rogers |
| 5,738,414 | A | | 4/1998 | Wieland et al. |
| 5,803,548 | A | * | 9/1998 | Battle |
| 5,813,737 | A | | 9/1998 | Stone |

* cited by examiner

*Primary Examiner*—Milton Nelson, Jr.
(74) *Attorney, Agent, or Firm*—Susan L. Firestone; Paul W. O'Malley

(57) ABSTRACT

The device relates to modular furniture. The furniture has a seat, a back and an arm that interlock with each other in a substantially vertical manner. These frames typically use hooks that interlock with slots. The furniture can also have an interconnected table.

22 Claims, 10 Drawing Sheets

MODULAR FURNITURE

BACKGROUND OF THE INVENTION

1. Field of the Invention:

The present invention relates to modular furniture that assembles without requiring the extensive use of tools.

2. Description of the Prior Art:

Modular or ready-to-assemble furniture, such as chairs or couches, is typically made by attaching components, such as the base, arms and the back, to each other. Once assembled, the furniture looks like conventionally manufactured non-modular furniture. The components may include cushioning material or a surface to support a pillow.

Modular furniture should be readily assembled and disassembled. The owner easily moves modular furniture by taking it apart and moving the parts to a new location. This advantage is particularly important in small spaces, such as small room or apartments which have close quarters.

The furniture's fabric attaches to the exterior of the components, either permanently such as by gluing or stapling, or temporarily such as with hook-and-loop fasteners, ties or buttons. Removable fabric allows the components to be disassembled and the fabric detached for cleaning and/or replacement.

One known modular furniture design includes armrests having one of a plurality of styles attached to the seating component. In such a modular furniture design, such as a couch, back cushions are placed on top of the seat cushions and are leaned against a headrest; or, alternatively, the back cushions are attached to seat cushions via a generally L-shaped ladder back frame. The ladder back frame includes two upstanding portions which are received within a space formed in the bottom of the arm cushions. The arm cushions may have one of a plurality of exterior shapes, with the overall style and appearance of the article of furniture remaining the same.

A problem with conventional modular furniture, and particularly seating furniture, is that while certain designs may allow one or a few components of the article of furniture to be relatively easily assembled or disassembled, the resulting structure is relatively weak and is therefore easily damaged. While additional support may be added to these designs, the additional support decreases the ease of assembly and disassembly of the modular furniture. Adding additional fasteners may provide additional support and hold the components together, but this increases the complexity of assembly or disassembly. Alternatively, the components may be enhanced to be self-supporting which greatly adds to their cost.

A major market for modular furniture is the commercial market for furnished apartments and dormitories, especially for college students. Students living in dormitories and furnished apartments are young and unsupervised, often drinking and partying. These students may roughly handle the furniture, often sitting on the arms and tables rather than within the supported seat. Easily damaged furniture does not last in this rough and tumble world of young adults.

U.S. Pat. No. 5,738,414, issued Apr. 14, 1998, to Wieland et al. and incorporated herein by reference in its entirety, addresses many of the above-recited problems. While the furniture is easily assembled, this furniture requires L-shaped metal brackets that slide into reinforced slots. The metal brackets are bolted to the furniture frame for stability.

Another design for modular furniture involves modular pieces that interlock horizontally without using a metal bracket. In this furniture design, horizontal tabs on the pieces, especially the arms, insert horizontally within slots. The furniture's feet are attached to the arm as well. With this type of horizontal interlocking, larger pieces of furniture, such as a sofa, have insufficient support in the middle and thus tend to sag in the middle. Another problem is when a large amount of weight is put on the arm, such as when a college student sits on the arm, the weight or force transfers to the attached feet. This transferred force increases the torque on the arm, which further weakens the horizontal connection. Over time and repeated abuse, the increased torque could cause the arm to separate from the rest of the seat, or possibly to break the arm off at the tab.

Additionally, interlocking horizontal tabs of the arm, with the horizontal slots of the seat can be difficult. Interlocking larger pieces horizontally is awkward and hard, especially for small people. Before interlocking, the assembler must align and slide a bulky piece of furniture horizontally.

Therefore, it is an object of the invention to produce modular furniture that avoids these problems. One object of the invention is to produce modular furniture that is structurally secure, especially larger pieces of furniture, without detracting from the assembly and disassembly or greatly increasing the cost of manufacturing. Another object of the invention is to produce releasably interlocking furniture pieces that can withstand substantial abuse without separation or breakage. Another object of the invention is to produce interlocking furniture that is less awkward to interlock, especially larger pieces of the furniture. Still another object of the invention is a modular furniture design which retains the exterior fabric while allowing for easy removal.

SUMMARY OF THE INVENTION

The invention relates to a modular furniture apparatus. The modular furniture has a seat and an arm that interlock in a substantially vertical manner. The seat has a top, a bottom, a front, a rear, and opposite sides, with a top slot in the top of the seat. The seat also has an outer shelf extending outwardly from the side and an inner shelf extending inwardly from the side. The outer shelf has a brace slot and the inner shelf has a brace opening.

The arm has an arm hook and a foot. The arm hook outwardly extends from the arm to releasably engage one of the top slots. The foot releasably mates with the brace slot of the outer shelf.

The furniture usually has aback and aback hook that extends downwardly from the back and releasably mates with the brace opening of the inner shelf. The back interlocks with the seat in a substantially vertical manner.

Additional effects, features and advantages will be apparent in the written description that follows.

DETAILED DESCRIPTION OF THE INVENTION

Figure 20:
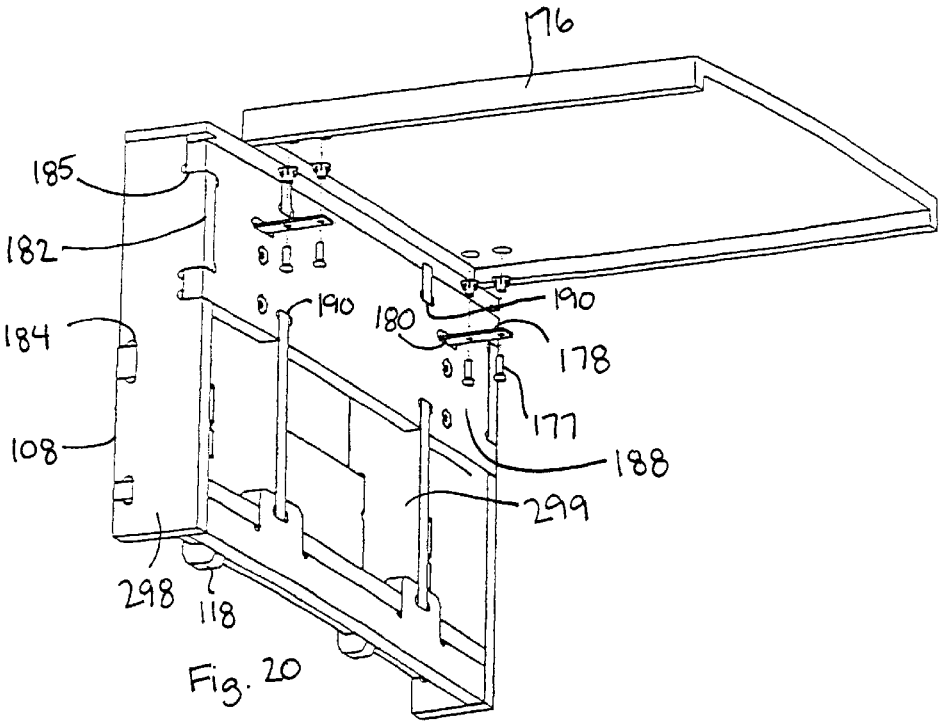
FIG. 20 is a perspective partially exploded view of an arm frame with a table support and a table the invention.

Turning to the figures where like reference numerals refer to like objects, the furniture of the invention assembles with interlocking components. Chair 10 has seat 8, back 61 and arm 97 (FIG. 20). In this disclosure, arm 97 refers to the vertical component of the furniture that interlocks with the side of the seat, which may include the side of a table or a bench. In this disclosure, back 61 refers to the vertical component of the furniture that interlocks with back of the seat 8, which may include the back of a table or a bench.

Seat 8 interlocks with back 61 and arm 97 in a substantially vertical manner. Seat 8 has top 2, bottom 3, front 4, rear 5 and opposing sides 6. Outer shelf 21 extends laterally from side 6 at or near bottom 3 of seat 8. Inner shelf 20 extends inwardly from side 6 at or near bottom 3 of seat 8. Arm hook 116 extends outwardly from arm 97 and releasably engages top slot 38 at top 2 and side 6 of seat 8. Foot 118 of arm 97 releasably mates with brace slot 27 in a substantially vertical manner. Vertical part 69 of back hook 68 releasably mates with brace opening 26. Legs 162 can attach to seat 8 at outer shelf.

Figure 1:
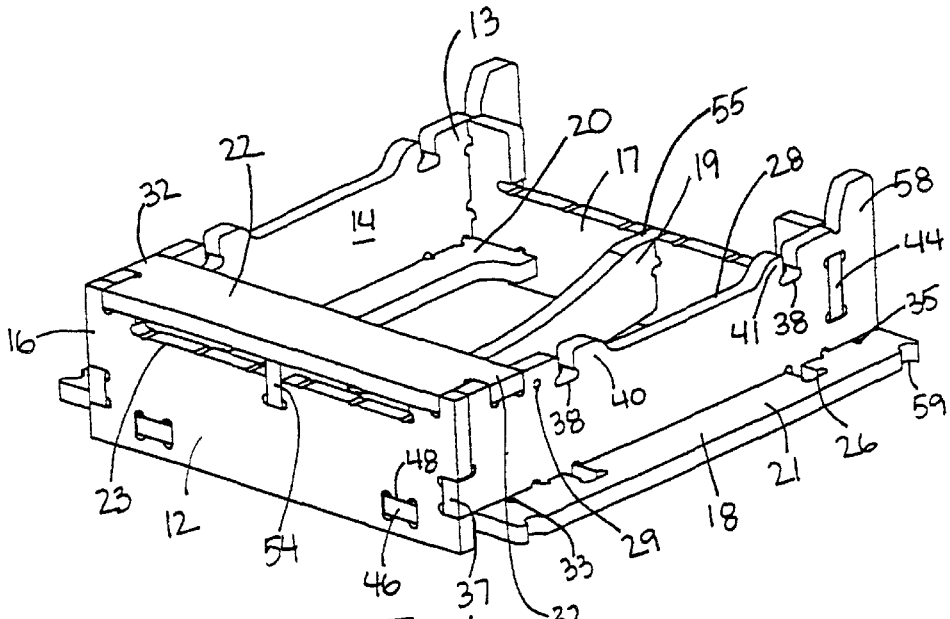
FIG. 1 is a perspective view of an assembled seat frame of the invention.
Figure 2:
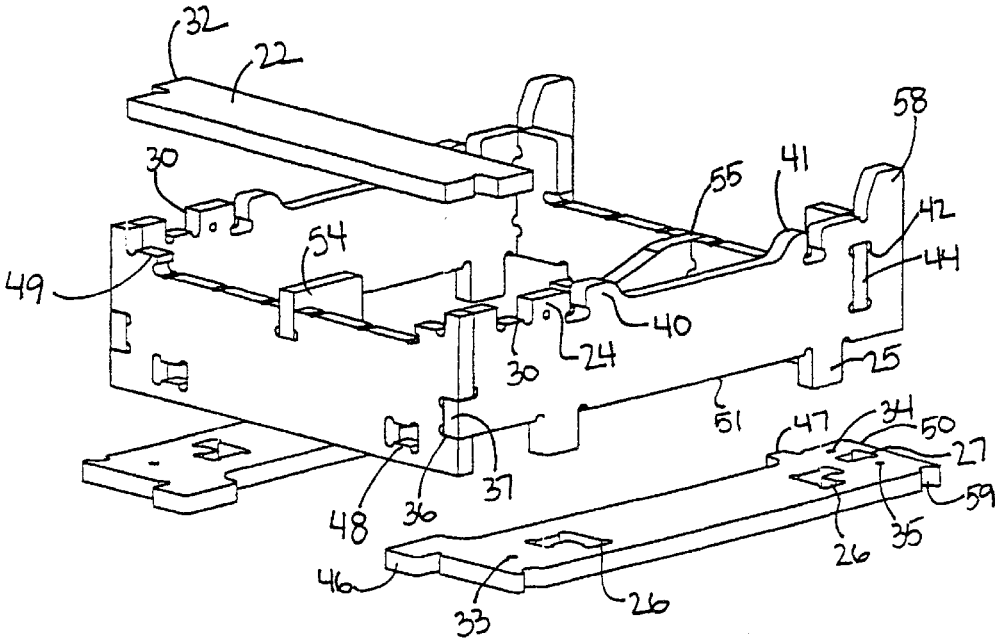
FIG. 2 is a perspective view of a partially assembled seat frame of the invention.
Figure 3:
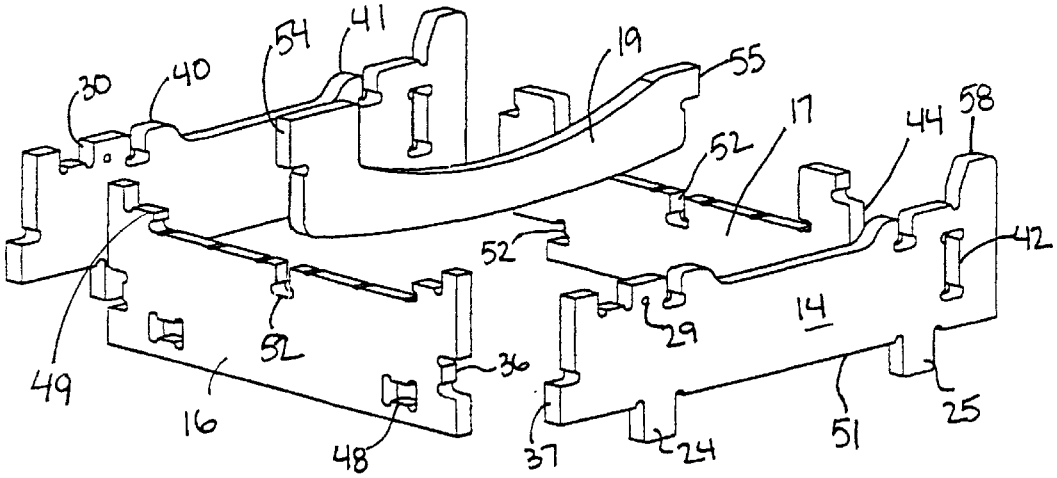
FIG. 3 is a perspective exploded view of a disassembled seat frame of the invention.

FIGS. 1–3 show the construction of seat frame 12 in seat 8. FIG. 1 shows seat frame 12 assembled with base 13, lower braces 18, medial brace 19 and shelf 22. Base 13 has front 16, rear 17 and opposing sides 14. Each side 14 has upper 24 and lower 25 tabs, and rear projection 58 extending beyond rear 17 and preferably above rear 17. Upper tabs 24, top notch 30 and top slots 38 define side top 28. Lower tabs 25 interconnect vertically with brace slots 26 in lower brace 18 and define side bottom 51. Brace slots 26 are preferably L-slots. When assembled, each side 14 rests on lower brace 18 which forms inner shelf 20 and outer shelf 21 of lower brace 18. Shelf 22 interconnects with sides 14 using shelf tabs 32 at the lateral sides of shelf 22 fitting within top notches 30 of side 14. Shelf 22 gains additional support from lateral seat support 49 at the lateral ends of front 16.

Lower brace 18 has front 46 and rear 47 brace tabs. Front brace tab 46 matingly engages front slot 48. Lower brace rear 50 slides within rear lower slot 52 of rear 17. Brace slots 26 of lower brace 18 are oriented at each end in opposite configurations of each other. Lower brace 18 also has brace opening 27 located rearward of lower brace 18, indentations 59 located at outer corners of lower brace 18 and first 33, second 34 and third 35 holes. First hole 33 is located forward front L-slot 26. Second 34 and third 35 holes are located opposite side of brace opening 27.

Front tab 54 and rear tab 55 of medial brace 19 interlock vertically with top slots 52 in front 16 and rear 17 of base 13. Front tab 54 of medial brace 19 and sides 14 at top notches 30 support shelf 22. Preferably, medial brace 19 has a curved top and/or bottom surface(s). Gaps 23 can form between front 16 and the bottom of shelf 22 and medial brace 19.

Front 16, rear 17 and sides 14 are preferably slats that interconnect to form base 13. Front tab 37 of side 14 fits within front notch 36 of front 16. Rear cleat 44 of rear 17 matingly engages rear opening 42 of side 14. Curved upper tabs 40, 41 of side 14 are located next to top slots 38, 39.

Figure 4:
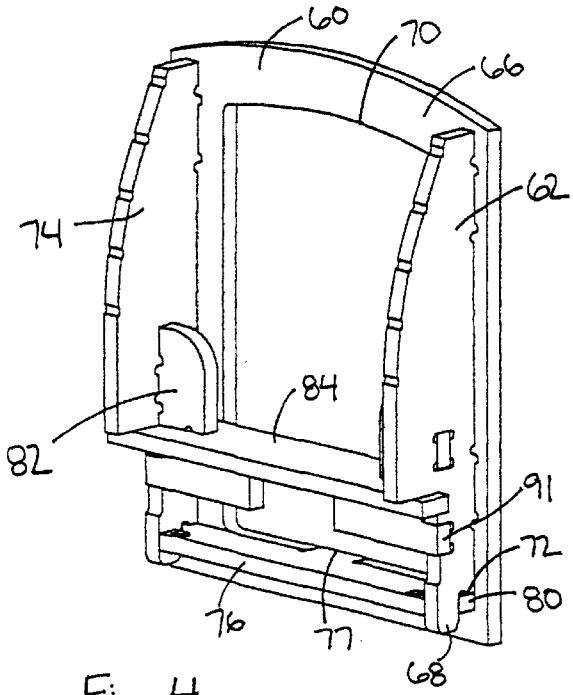
FIG. 4 is a perspective view of an assembled back frame of the invention.
Figure 5:
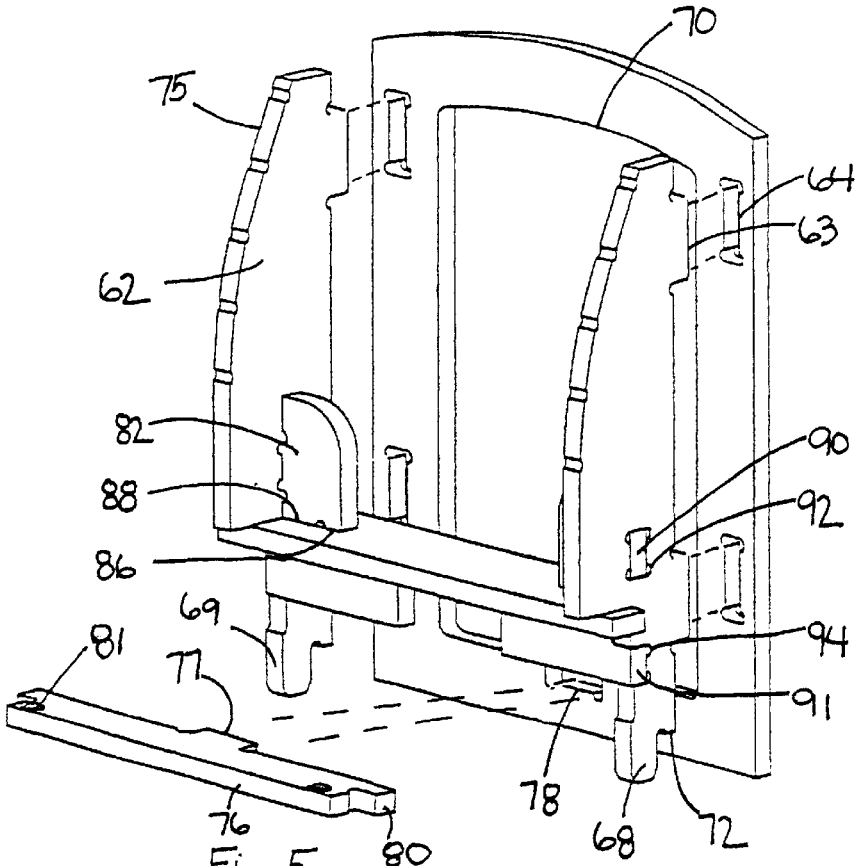
FIG. 5 is a perspective exploded view of a partially assembled back frame of the invention.
Figure 6:
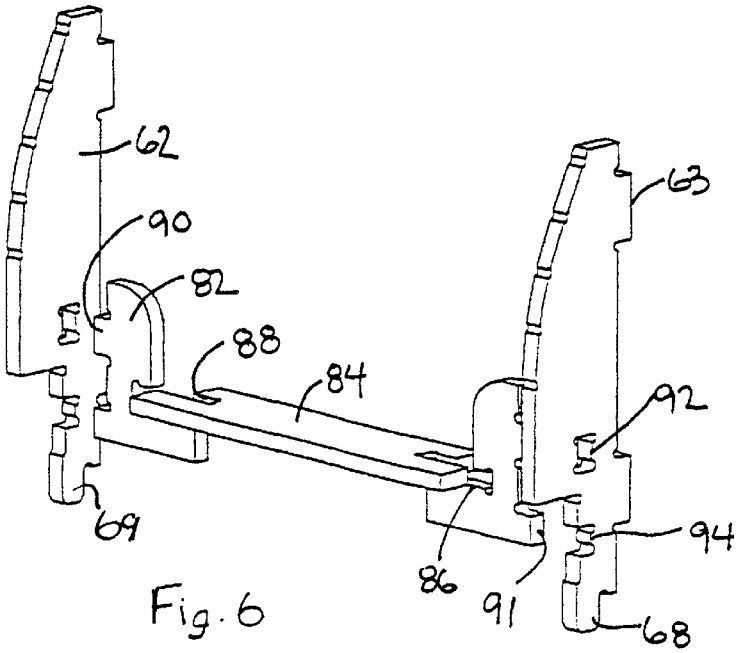
FIG. 6 is a perspective exploded view of a disassembled back support of the invention.

Turning to FIGS. 4–6 for the construction of back frame 60 of back 61, back frame 60 has windowed back 66 with window 70, and back support 74. Back support 74 preferably has back hook 68, shoulder 72 and male vertical slats 62 with back tabs 63 that matingly engage side openings 64 of windowed back 66. Back support front 75 can be at least partially curved, depending on the final design of chair 10.

Back bracket 82 of back support 74 has inner bracket slots 86 that interlock with brace slots 88 of back brace 84. Upper bracket tabs 90 fit within vertical slat openings 92 in male vertical slats 62. Lower bracket tabs 91 fit within lower back notch 94 of male vertical slats 62.

Opposite side projections 80 of male support 76 fit between back foot 68 and windowed back 66 and beneath shoulder 72. Male support 76 matingly engages lower opening 78 of windowed back 66 with support tab 77. Side bores 81 are laterally located in male support 76.

Figure 7:
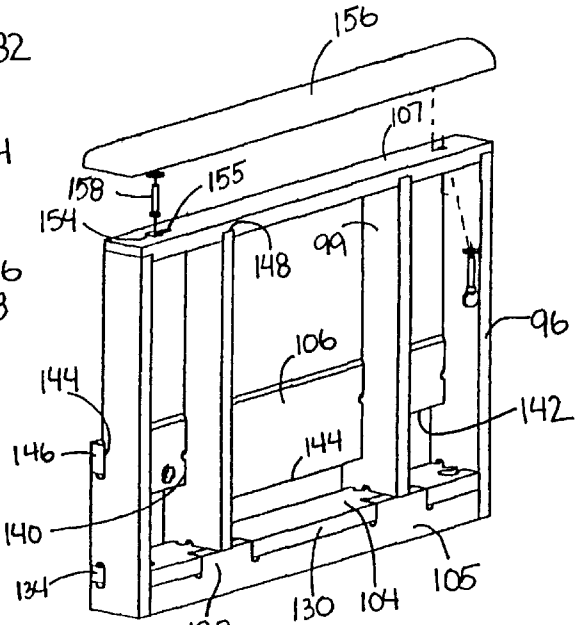
FIG. 7 is a perspective exploded view of a partially assembled arm frame of the invention.
Figure 8:
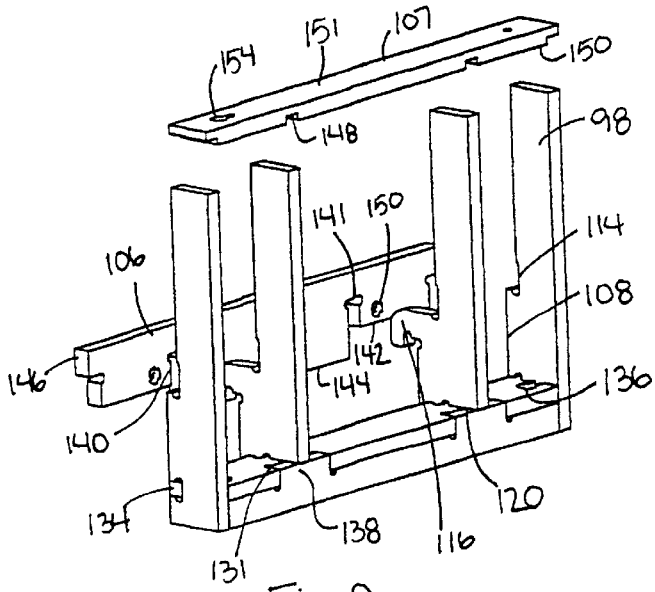
FIG. 8 is a perspective exploded view of a partially assembled arm frame of the invention.
Figure 9:
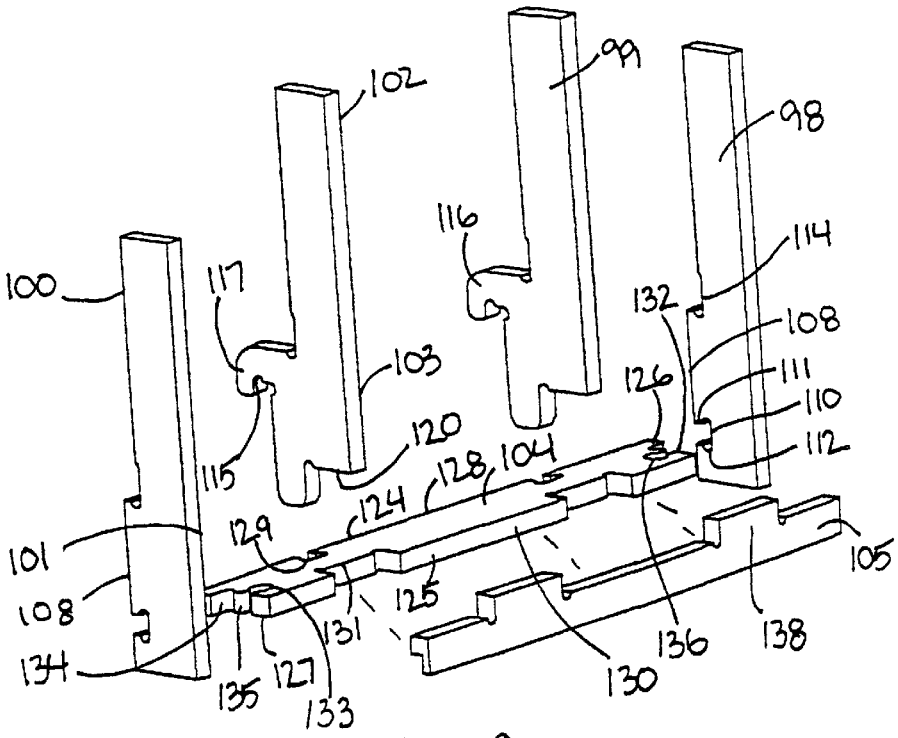
FIG. 9 is a perspective exploded view of an arm frame of the invention.
Figure 10:
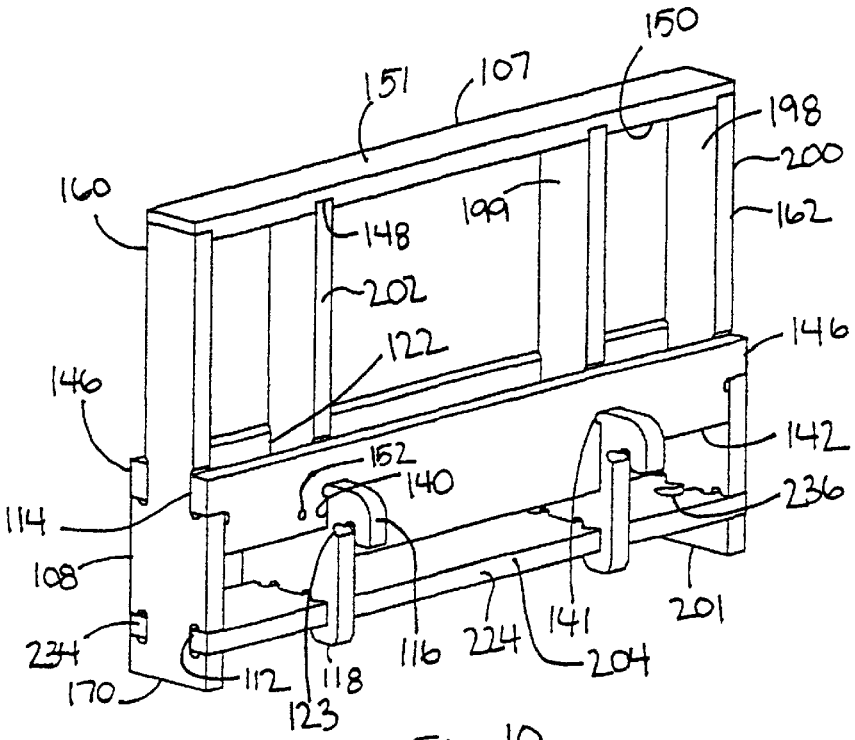
FIG. 10 is a perspective exploded view of an assembled arm frame of the invention.
Figure 11:
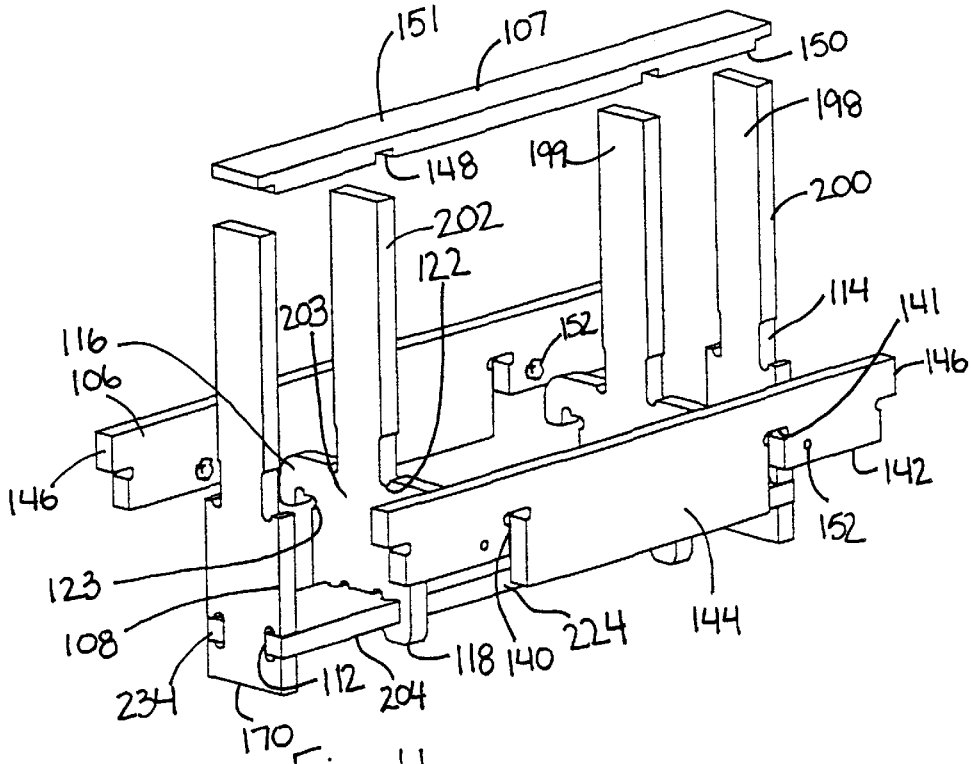
FIG. 11 is a perspective exploded view of a partially assembled arm frame of the invention.
Figure 12:
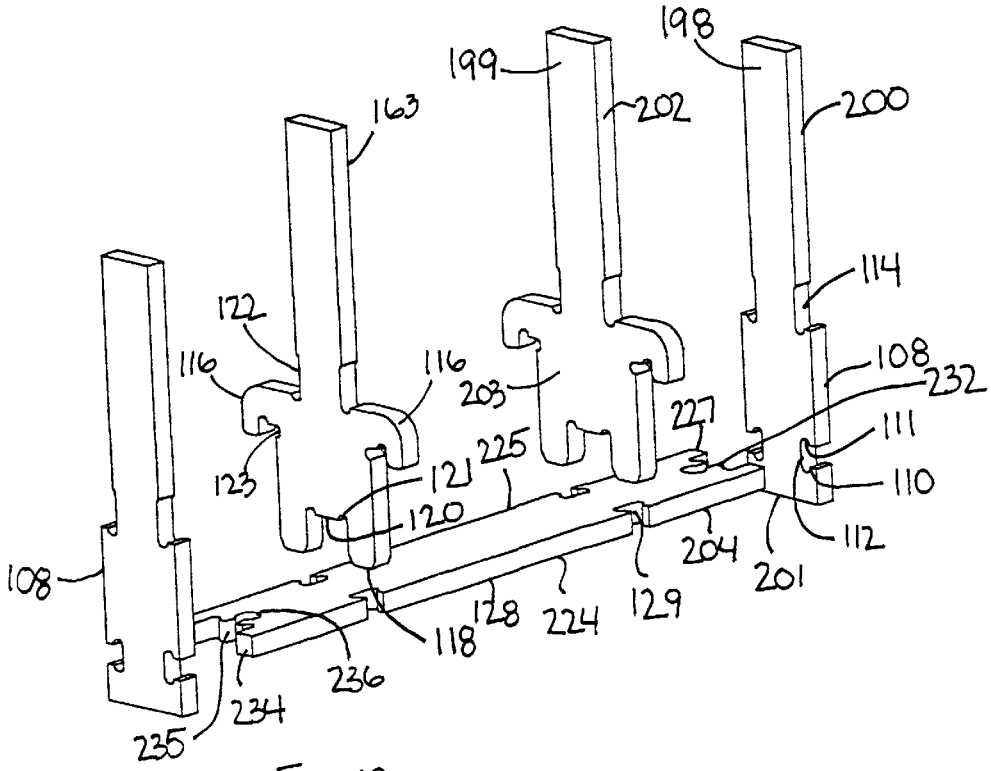
FIG. 12 is a perspective exploded view of a partially assembled arm frame of the invention.
Figure 14:
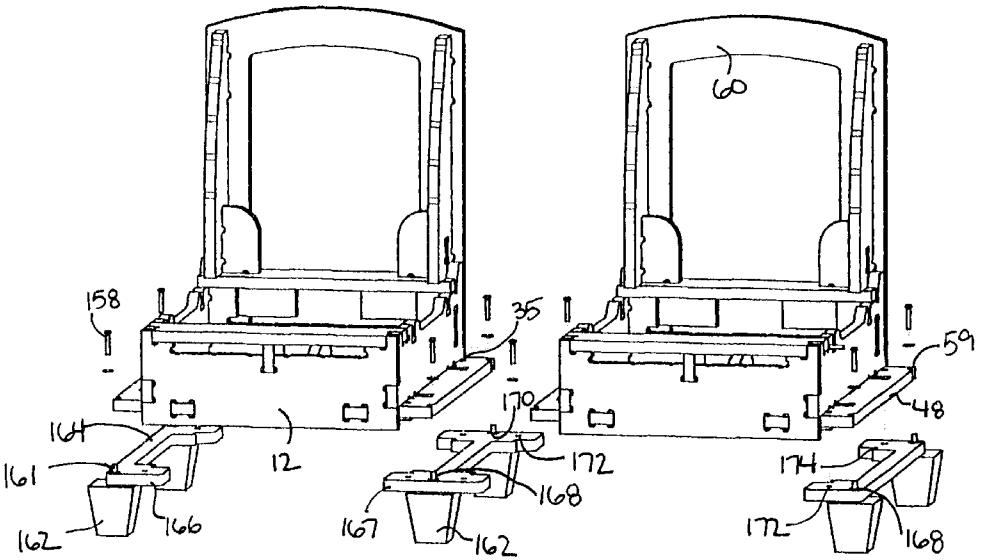
FIG. 14 is a perspective exploded view of a seat frame and a back frame of the inventions.
Figure 15:
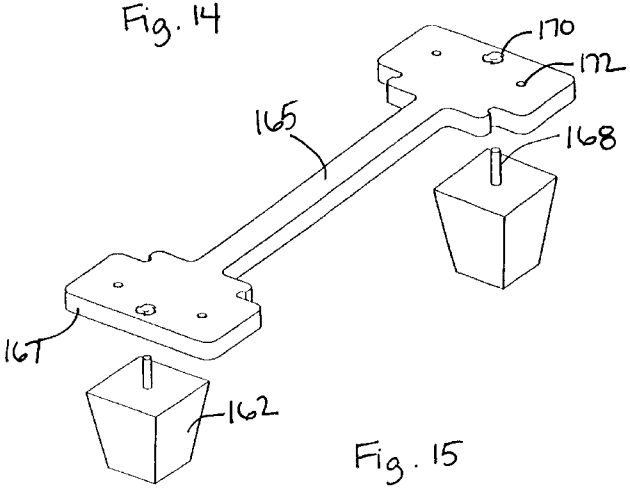
FIG. 15 is a perspective exploded view of a chair leg of the invention.
Figure 17:
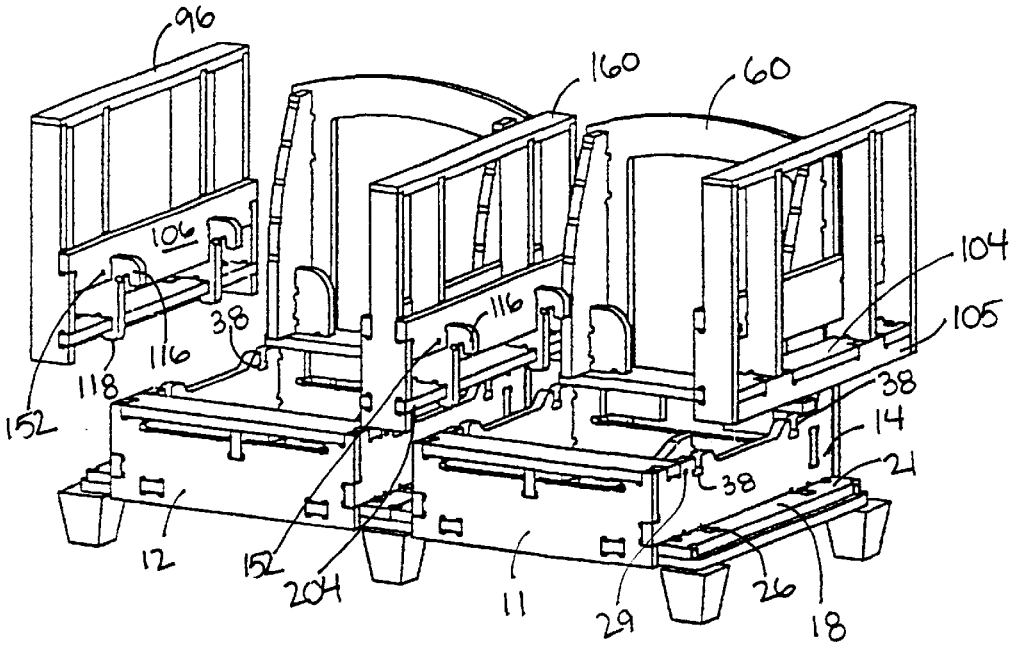
FIG. 17 is a perspective partially exploded view of a partially assembled chair of the invention.
Figure 16:
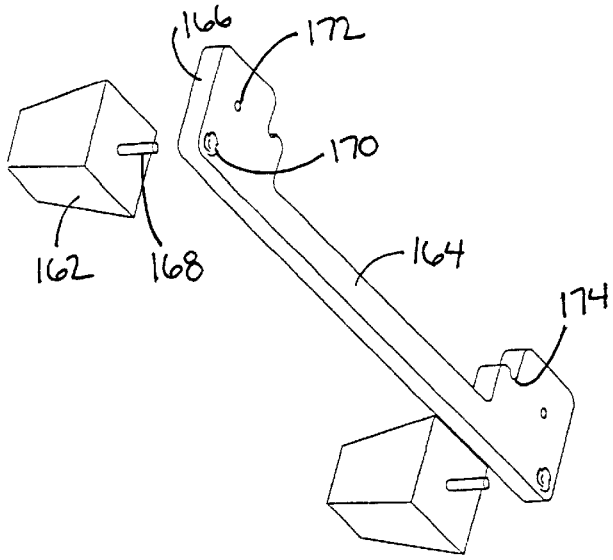
FIG. 16 is a perspective exploded view of a different chair leg of the invention.

FIGS. 7–9 show the construction of outer arm frame 96 of arm 97. Outer arm frame 96 has vertical 98, 99 and horizontal 104, 105, 106, 107 arm slats that matingly engage each other in an approximately perpendicular relationship. Additional slats can be used to adapt the arm frame for other uses, such as table support slat 188 shown in FIGS. 19–20.

Each vertical arm slat 98, 99 has upper 100, 102 and lower, 101, 103 portions and medial slot 114, 122. As shown, the width of upper portion 100, 102 is less than the width of lower portion 101, 103 of vertical arm slat, although it can be the same width if desired (see FIGS. 21–22). The depth of medial slot 114, 122 is preferably about the width of middle horizontal slat 106.

Vertical outer arm slat 98 has lower cleat 108 formed between lateral opening 110 and medial slot 114. Lateral opening 110 has linear neck 111 leading to an elongated slot 112. At the opposite end of lower cleat 108 is medial slot 114.

Vertical inner arm slat 99 has arm hook 116 extending outwardly, foot 118 and bottom 120. Preferably medial slot 122 is at one end of arm hook 116 and lower curve 123 lies beneath arm hook 116. Arm hook 116 has vertical portion 117. Bottom curve 121 lies between bottom 120 and foot 118.

Lower horizontal arm slat 104 matingly engages vertical arm slats 98, 99. Lower horizontal arm slat 104 has opposite first 124 and second 125 slat sides and opposite third 126 and fourth 127 slat sides. First slat side 124 has small openings 129 that define lower horizontal cleat 128. Second slat side 125 has arm notches 131 opposite small openings 129, and second horizontal cleat 130 between small openings 129. Third 126 and fourth 127 slat sides have lateral key structures 132, 133, with the fourth slat side 127 lateral key structure 133 a mirror image of the third slat side 126 lateral key structure 132. Each lateral key structure 132, 133 has nose 134, mouth 136 and constricted neck 135.

Outer horizontal arm slat 105 matingly engages lower horizontal arm slat 104 in an approximately perpendicular manner. Outer horizontal arm slat 105 has teeth 138 which approximately perpendicularly engage arm notches 131 on second slat side 125 of lower horizontal arm slat 104. Second horizontal cleat 130 engages outer horizontal arm slat 105 between teeth 138.

Middle horizontal arm slat 106 has channels 140, 141 that define lateral 142 and medial 144 arm cleats and lateral extensions 146 at opposite lateral ends. Arm bore 152 extends through lateral cleat 142 of middle horizontal arm slat 106. Middle horizontal arm slat 106 matingly engages vertical arm slats 98, 99 at medial slots 114, 122 in an approximately perpendicular manner. Top horizontal arm slat 107 has grooves 148 on the inner face 150 to matingly engage the top of each vertical arm slat 98, 99 similar to a tongue and groove attachment.

Arm cap 156 can attach to top horizontal arm slat 107 with a fastener 158 extending through keyhole 154 in top horizontal arm slot 107 into arm cap 156. Keyhole 154 extends from inner face 150 to the outer face 151 near each end of top horizontal arm slat 107. Preferably fastener 158 extends from arm cap 156 and locks within keyhole 154 by sliding into keyhole channel 155.

Inner arm frame 160 can be used for larger furniture as shown in the Figures. Inner arm frame 160 has vertical exterior 198 and interior 199 slats and horizontal 204, 106, 107 slats that matingly engage each other in an approximately perpendicular relationship. Inner arm frame 160 uses the same middle 106 and top 107 horizontal arm slats as for the outer arm frame. Arm cap 156 can be used as well. Each vertical slat 198, 199 has upper 200, 202 and lower, 201, 203 portions and medial slots 114, 122 as well. The width of upper portion 200, 202 can be less than the width of lower portion 201, 203 of vertical slats 198, 199.

Vertical exterior 198 and interior 199 slats are symmetric along a central vertical axis, as their opposite sides are mirror images of each other and are preferably identical to the nonlinear side of vertical arm slats 98, 99. Vertical exterior slat 198 has lower cleats 108 formed between lateral openings 110 and medial slots 114. Lateral opening 110 has linear neck 111 leading to an elongated slot 112.

Vertical interior slat 199 has arm hooks 116 extending outwardly from opposite faces of arm frame 160, feet 118 and bottom 120. Preferably medial slot 122 is at one end of arm hook 116 and lower curve 123 lies beneath arm hook 116. Arm hook 116 has vertical portion 117. Bottom curve 121 lies between bottom 120 and foot 118.

Lower horizontal arm slat 204 matingly engages vertical exterior 198 and interior 199 slats. Lower arm slat 204 is symmetric along a central horizontal axis with opposite first 224 and second 225 slat sides mirror images of each other. Opposite third 226 and fourth 227 slat sides are also mirror images of each other. First 224 and second 225 slat sides have small openings 129 that define lower horizontal cleat 128. Third 226 and fourth 227 slat sides have lateral key structures 232. Lateral key structure 232 has nose 234, mouth 236 and constricted neck 235. The rest of inner arm frame 116 assembles as previously described for outer arm frame 96.

Figure 13:
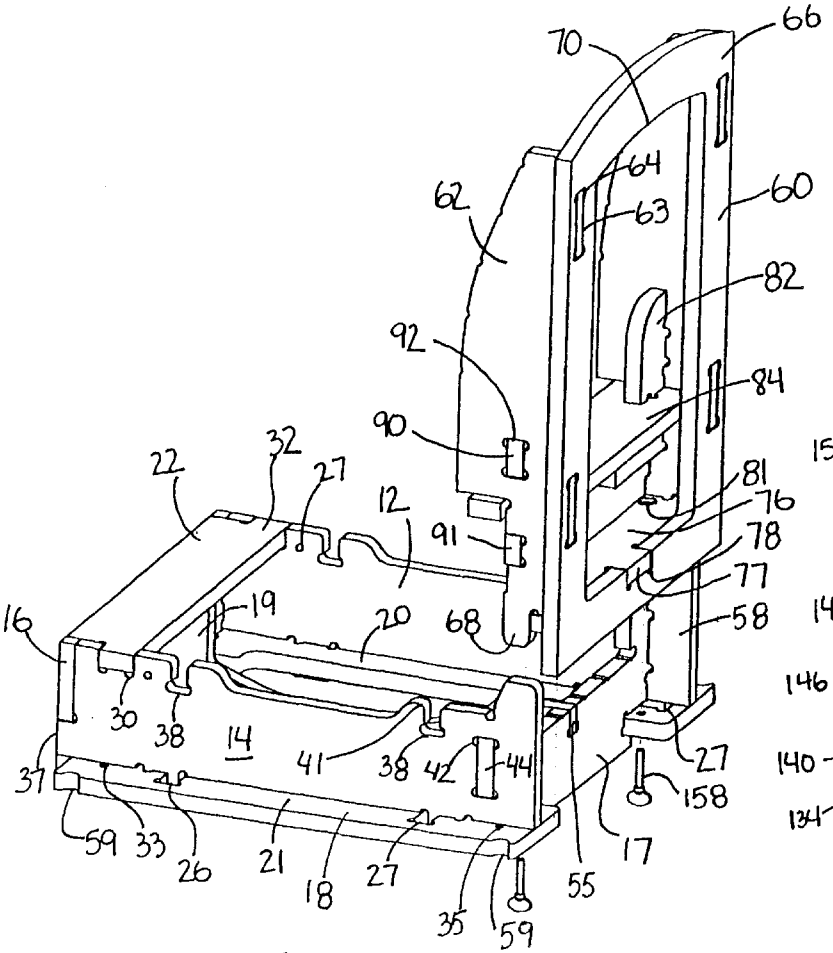
FIG. 13 is a perspective exploded view of a partially assembled back frame of the invention.
Figure 18:
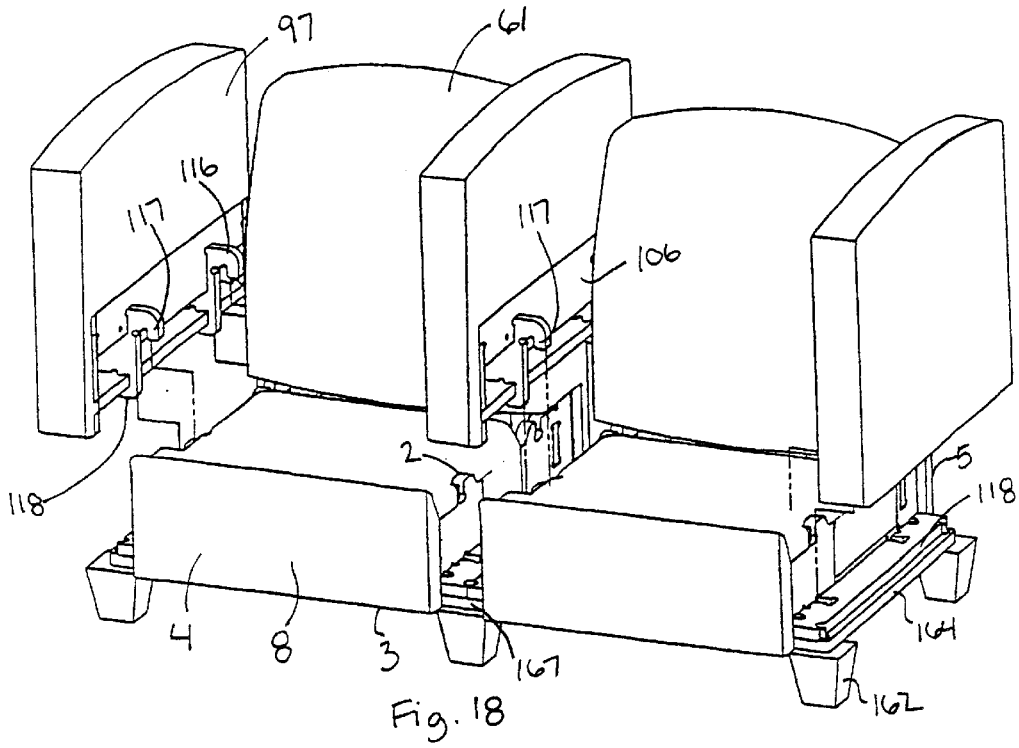
FIG. 18 is a perspective partially exploded view of a partially assembled chair of the invention.

To assemble chair 10, assembled back frame 60 interlocks with assembled seat frame 12 (FIG. 13). Vertical part 69 of back hook 68 of back frame 60 inserts within rear opening 27 of lower brace 18 to releasably mate in a substantially vertical manner. Rear 17 of base 13 supports horizontal brace 84 of back frame 60. Lower brace 18 supports male support 76 of back frame 60. Fastener 160, such as a thumbscrew, T-bolt, bolt and washer, bolt and wing nut, screw, lag screw, and the like, inserts within second hole 34 of lower brace 18 and into side bore 81 of male support 76. All fasteners can be countersunk within holes, bores and apertures, if desired.

Seat frame 12 attaches to chair legs 162 using skid rails 164, 165 with opposite heads 166, 167. U-shaped skid rails 164 are used on the outer side of the chair, while I-shaped skid rails 166 are used to support the inner section of larger furniture. Heads 166, 167 have leg fasteners, such as dowels 168 that insert through and project out of dowel apertures 170 in skid rail 166, 167, leg apertures 172 and inner J-curve 174.

Legged seat frame 11 forms after seat frame 12 is placed onto skid rails 164, 166 to attach chair legs 162. Each dowel 168 slides into one indentation 59 of lower brace 18. Fastener 160 inserts through third hole 35 of lower brace 18 and into fastener aperture 172 of the skid rails.

Arm frames 96, 160 attach to legged seat frame 11. Each foot 118 releasably mates with the exposed brace slot 26 of lower brace 18 in a substantially vertical manner. Arm hook 116 interlocks within top slot 38 of side 14 with arm slot 115 engaging top slot 38 in a substantially vertical manner. Outer shelf 21 of lower brace 18 supports lower horizontal arm slat 104. Fastener 158 fastens arm frames to seat frame 12 by inserting though arm bore 152 of middle horizontal arm slat 106 and into upper hole 29 of side 14.

Figure 19:
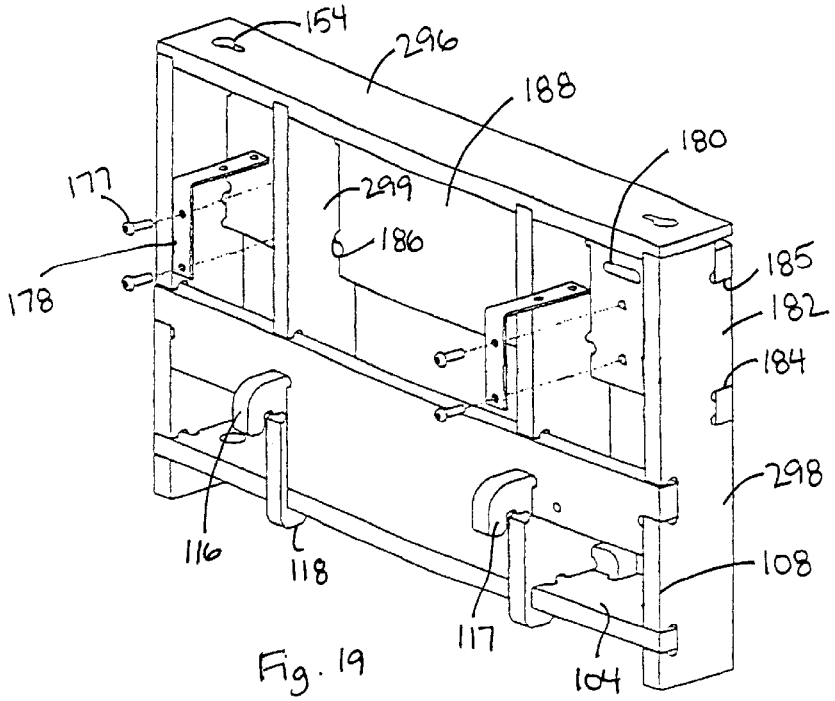
FIG. 19 is a perspective view of an arm frame with a table support for a table of the invention.

FIGS. 19–20 show how the modular furniture of the invention can be modified to produce other articles of modular furniture. A table, for example, assembles to a chair instead of a second seat.

As shown in FIGS. 19–20, table support 178 fastens to modified arm frame 296. Modified arm frame 296 has upper cleat 182 in outer vertical slat 298 which is the opposite mirror image of lower cleat 108. Upper cleat 182 is located between first 184 and second slots 185 in outer vertical slat 298 in the side opposite arm hook 116. Inner vertical slat 299 has third slot 186.

Table support slat 188 interlocks with first 184, second 185 and third 186 slots of outer 298 and inner 299 vertical arm slats. Table support slat 188 can have internal slots 190 that engage inner vertical arm slats 299. Table support slat 188 has support aperture 180 through which table support 178 extends. Fasteners 177 fasten table top 176 to table support 178 in the same manner as the arm cap fastens to the arm frame. The table can extend outwardly and is supported much like a cantilever.

Alternatively, another modified arm frame 296 can be used to fasten and support table top 176 at the other end (not shown). In this embodiment, if the back frame is used, it can be modified to the height of arm frames.

Upholstery batting, springs, and the like, attach to the frames after assembling the frames before attaching one frame to the other as shown in FIG. 20. Fabric covers the frames using any method known and can attach after assembling the frames. U.S. Pat. No. 5,738,414 shows one method of attaching the fabric. Other methods can include using ties, fastening tape, fasteners, staples, glue, and the like. Eyelets can be used in the fabric where the fastener penetrates the fabric.

The modular furniture of the invention has a number of advantages. One advantage is the modular furniture of the invention produces a number of design alternatives. The height of the back and arm can vary, depending on the style of furniture. Arms, for example, shorten by decreasing the height of the upper portion of the vertical arm slats. Similarly, the back shortens by decreasing the height and size of the windowed back and back support. The design of the back, such as a flat back rather than a curved back, can be changed by simply changing the shape of the back support. Another possible table design would use a widened central skid rail to put in a table between the two seats and supported by the arm frames (not shown). Another modification would be to form a bench using a widened seat and shortened arm frames. Similarly, a love seat or sofa could be built using a widened seat frame and multiple back frames interlocking with the widened seat frames, with or without using the inner arm frame. In this embodiment, the inner shelf can be elongated to accommodate the additional back frames.

Another advantage of the invention is the modular furniture is structurally secure, especially in the interior, without detracting from the assembly and disassembly or greatly increasing the cost of manufacturing. Because the chair legs are on the frame, if someone sits on the arm, the weight is downward onto the chair legs rather than outward. This reduces the potential of increasing torque on the arm and a possible separation of the arm from the seat frame.

The use of the rear projection of the side of the seat frame and the lower part of the back guide the back frame when sliding the back frame into position. The rear projection and lower part of the back also provide structural support for the chair. The design prevents the back from falling backward, especially under abusive conditions such as picking up the chair by the back, while the rear projection keeps the back from moving laterally.

Another advantage of the invention is a system of releasably interlocking furniture pieces that withstand substantial abuse without separation or breakage and without using metal brackets bolted to the furniture. This allows the ready assembly and disassembly of the furniture without an extensive use of tools, especially using a large number of tools.

Still another advantage of the invention is its easy assembly. Rather than aligning and sliding pieces horizontally, the modular furniture of the invention is mostly assembled vertically. Vertical assembly takes advantage of gravity. When sliding an arm frame into the seat frame, for example, the assembler can gently drop the arm hook into the brace slot and push the arm frame until locking the arm frame into position.

Another advantage of the invention is that the pieces can be universal. The arm frame, for example, can be adapted to build a modular table.

Still another advantage of the invention is that the fasteners are readily accessible for assembly and disassembly. The use of the common fasteners does not require a lot of tools to build the furniture. Plus, the fasteners in the furniture are easy to reach without picking up assembled parts of the frame.

Yet, another advantage of the invention is the arm or back can be assembled to the seat before the other. This allows soiled pieces of the furniture to be disassembled for easy cleaning when other parts of the furniture do not require cleaning. The design also allows the easy removal of the exterior fabric for cleaning or replacement.

While the invention is shown in only one of its forms, it is not thus limited but is susceptible to various changes and modifications without departing from the spirit and scope of the invention.

What is claimed is:

1. A modular furniture apparatus, comprising:

a seat having a top, a bottom, a front, a rear, and opposite sides;

a top slot in the top of the seat;

an outer shelf extending outwardly from the side;

a brace slot in the outer shelf;

an inner shelf extending inwardly from the side;

a brace opening in the inner shelf;

a back;

a back hook extending downwardly from the back and releasably mating with the brace opening in a substantially vertical manner;

an arm having an arm hook, and a foot;

the arm hook outwardly extending from the arm and releasably engaging the top slot; and the foot releasably mating with the brace slot in a substantially vertical manner.

2. A modular furniture apparatus of claim 1, further comprising:

chair legs having skid rails with opposite heads, the chair legs engaging the outer shelf.

3. A modular furniture apparatus of claim 2, further comprising:

an inner arm having arm hooks that extend from opposite faces of the inner arm.

4. A modular furniture apparatus of claim 2, further comprising:

a table top fastened to the arm.

5. A modular furniture apparatus, comprising:

a seat frame having a front, a rear, and opposite sides, each side having a side top and a side bottom;

a top slot at the side top;

lower braces interconnecting with each side bottom, each brace having an outer shelf extending outwardly from the side bottom;

a brace slot in the outer shelf;

an arm frame having an arm hook, and a foot;

the arm hook outwardly extending from the arm frame and releasably engaging the top slot; and the foot releasably mating with the brace slot in a substantially vertical manner.

6. A modular furniture apparatus of claim 5, further comprising:

vertical arm slats interlocking with horizontal arm slats to form the arm frame, and wherein the arm hook and foot are part of one of the vertical arm slats.

7. A modular furniture apparatus of claim 6, further comprising:

medial slots within the vertical arm slats that interlock with one of the horizontal arm slats.

8. A modular furniture apparatus of claim 7, wherein the vertical arm slats include a vertical inner arm slat located between two vertical outer arm slats; and the arm hook and foot are part of the vertical inner arm slat.

9. A modular furniture apparatus of claim 8, wherein the horizontal arm slats include a lower horizontal arm slat having a first slat side with a small opening engaging the arm hook, and lateral key structures at opposite ends engaging lateral openings in the vertical outer arm slats.

10. A modular furniture apparatus of claim 9, wherein the horizontal arm slats include a middle horizontal arm slat having lateral extensions at opposite ends, and channels defining lateral arm cleats and medial arm cleats, the middle horizontal arm slat engaging the medial slots of the vertical arm slats.

11. A modular furniture apparatus of claim 10, further comprising:

an inner arm frame having arm hooks that extend from opposite faces of the arm frame.

12. A modular furniture apparatus of claim 11, further comprising:

a table top fastened to the arm frame.

13. A modular furniture apparatus of claim 7, further comprising:

an inner shelf being part of the lower brace and extending inwardly from the side bottom;

a brace opening in the inner shelf;

a back frame; and a back hook extending downwardly from the back frame and releasably mating with the brace opening in a substantially vertical manner.

14. A modular furniture apparatus of claim 13, further comprising:

a back;

a back support matingly engaging the back; and wherein the back hook extends downwardly from the back support.

15. A modular furniture apparatus of claim 14, further comprising:

a back bracket; and a back brace interlocking with the back bracket and the back support.

16. A modular furniture apparatus of claim 15, wherein the back support further comprises:

male vertical slats having a back tab, and a back hook to interlock with the back brace.

17. A modular furniture apparatus of claim 16, further comprising:

rear projections in the side extending beyond and above the rear.

18. A modular furniture apparatus of claim 17, wherein the vertical arm slats include a vertical inner arm slat located between two vertical outer arm slats; and the arm hook and foot are part of the vertical inner arm slat.

19. A modular furniture apparatus of claim 18, wherein the horizontal arm slats include a lower horizontal arm slat having a first slat side with a small opening engaging the arm hook, and lateral key structures at opposite ends engaging lateral openings in the vertical outer arm slats.

20. A modular furniture apparatus of claim 19, wherein the horizontal arm slats include a middle horizontal arm slat having lateral extensions at opposite ends, and channels defining lateral arm cleats and medial arm cleats, the middle horizontal arm slat engaging the medial slots of the vertical arm slats.

21. A modular furniture apparatus of claim 20, further comprising:

an inner arm frame having arm hooks that extend from opposite faces of the arm frame.

22. A modular furniture apparatus of claim 21, further comprising:

a table top fastened to the arm frame.

* * * * *